United States Patent [19]

Herrmann

[11] 4,243,736

[45] Jan. 6, 1981

[54] LIQUID DEVELOPER AND COPOLYMER POLARITY CONTROL AGENT FOR USE THEREWITH

[75] Inventor: Heinz Herrmann, Wiesbaden, Fed. Rep. of Germany

[73] Assignee: Hoechst Aktiengesellschaft, Fed. Rep. of Germany

[21] Appl. No.: 940,601

[22] Filed: Sep. 8, 1978

[51] Int. Cl.[3] ..... G03G 9/12

[52] U.S. Cl. ..... 430/115; 526/264

[58] Field of Search ..... 252/62.1 L; 526/264; 430/115

[56] References Cited

U.S. PATENT DOCUMENTS

| | | | |
|---|---|---|---|
| 2,497,705 | 2/1950 | Wernitz | 526/264 |
| 3,044,873 | 7/1962 | Haas | 526/264 X |
| 3,542,681 | 11/1970 | Mutaffis | 252/62.1 L |
| 3,993,483 | 11/1976 | Maki et al. | 252/62.1 L X |

FOREIGN PATENT DOCUMENTS

| | | | |
|---|---|---|---|
| 50-80136 | 6/1975 | Japan | 252/62.1 L |
| 51-40465 | 11/1976 | Japan | 252/62.1 L |

*Primary Examiner*—Roland E. Martin, Jr.
*Attorney, Agent, or Firm*—James E. Bryan

[57] ABSTRACT

This invention relates to an improvement in a liquid developer for the development of electrostatic charge images, comprising an electrically insulating carrier liquid in which pigments or dyestuffs, resinous binders, a polarity control agent, and conventional additives are dispersed or dissolved, the improvement that the polarity control agent is a copolymer which is soluble in the carrier liquid and is composed of 1 to 50 percent by weight of N-vinyl-2-pyrrolidone and 50 to 99 percent by weight of a methacrylic acid ester.

14 Claims, No Drawings

LIQUID DEVELOPER AND COPOLYMER POLARITY CONTROL AGENT FOR USE THEREWITH

The present invention relates to a liquid developer for developing electrostatic charge images, comprising an electrically insulating carrier liquid of high resistivity and low dielectric constant in which pigments, dyestuffs, resinous binders, polarity control agents and conventional additives are dispersed or dissolved. Further, the invention relates to the polarity control agent used.

Liquid developers are used in electrophotographic or electrographic copying processes in order to render the latent electrostatic charge images visible. In principle, these developers are composed of colored particles dispersed in a solution containing resinous binders and a polarity control agent in a carrier liquid. The colored particles with the polarity control agent and the binder adhering thereto are electrophoretically deposited in the electrical field of the charge image.

It is known to provide the pigments with a resin coating before dispersing them. These resins, which also may be polymers, are attached to the pigment particles by a physical or chemical process, e.g. by graft polymerization (see U.S. Pat. No. 3,968,044, or German Offenlegungsschrift No. 2,538,581). In this manner, particularly stable dispersions are produced.

The resins applied to the surface of the pigment particles to some extent act as polarity control agents and their influence may be so strong that no further polarity control agents are required for such pigment dispersions.

Together with the resins or polymer coatings applied to the surface of the pigment particles, the resinous binders dissolved in the carrier liquid serve to fix the pigment particles to the charge image, or, after transfer, to an appropriate substrate for the copy, for example paper.

If the pigment particles are to be transferred from the photoconductive layer to smooth paper, the proportion of fixing resin must be particularly high. Resins which are soluble in aliphatic hydrocarbons are not very suitable for the preparation of such pigment particles, because the quantity of resin required would increase the viscosity of the carrier liquid to such an extent that electrophoretic deposition would be impeded. On the other hand, developer liquids of this type can be successfully prepared by using dispersions of polymers in aliphatic hydrocarbons, i.e., so-called organosols or dispersimers. In this manner, low viscosity developer liquids with a high binder content are obtained which readily lend themselves to electrophoretic deposition. Liquid developers of this type have been disclosed in German Offenlegungsschriften No. 2,532,282, No. 2,600,200, and No. 2,114,773.

The polarity control agent, which is soluble in the aliphatic solvent, is normally absorbed from the solution by the pigment particles and determines the magnitude and polarity of their charge. Frequently, the polarity control agent also acts as a dispersing agent. Otherwise, the liquid developer contains an additional dispersing agent.

Most known polarity control agents impart a positive charge to the pigment particles, so that the pigment particles can be applied to negatively charged electrostatic charge images; examples thereof are, in particular, metallic soaps. A negative charge of the pigment particles is caused by such polarity control agents as lecithin, alkylated polyvinyl pyrrolidones, or the metal salts of long-chain alkylbenzene sulfonic acids or of long-chain dialkyl sulfosuccinic acid (see German Offenlegungsschriften Nos. 1,930,784, and 2,402,953).

It was found, however, that the known polarity control agents causing a negative charge of the pigment particles do not quite satisfy the requirements. In the case of pigment particles which are rich in polymers and may be transferred from the photoconductor layer to receiving sheets, the charge frequently is insufficiently controlled. In many cases, the polarity control agent has an unduly high electrical conductivity. If polarity control agents of weak controlling effect, but with a relatively high electrical conductivity, are added in such a quantity that the necessary good polarity control is achieved, the liquid developer acquires an unduly high electrical conductivity. This effect is particularly disturbing if fresh developer concentrate has been repeatedly replenished. In some cases, the polarity control agents even have the drawback that they attack the photoconductor layers during prolonged action in the copying apparatuses.

Some of the known polarity control agents even possess several of the above-mentioned disadvantages simultaneously.

Thus, it is the object of the present invention to provide negatively charging polarity control agents which possess a strong controlling action in combination with a low electrical conductivity and which do not attack the photoconductor layers.

This object is achieved by a liquid developer of the above described type in which the polarity control agent is a copolymer which is soluble in the carrier liquid and is composed of 1 to 50 percent by weight of N-vinyl-2-pyrrolidone and 50 to 99 percent by weight of a methacrylic acid ester. In a preferred embodiment, the copolymer contains 15 to 40 percent by weight of N-vinyl-2-pyrrolidone and 60 to 85 percent by weight of a methacrylic acid ester.

In this manner, a high negative charge is imparted to the pigment particles contained in the carrier liquid. Liquid developers containing the polarity control agents according to the invention enable a clean development, without background staining, of positively charged latent electrostatic charge images.

Copolymers containing methacrylic acid esters with alcohol components which carry at least 6 carbon atoms in a straight or branched chain are particularly suitable. 2-Ethyl-hexylmethacrylate, dodecyl methacrylate, and octadecyl methacrylate are preferably used as methacrylic acid esters.

As an additional effect, it is thus achieved that the polarity control agent according to the invention is readily soluble in the carrier liquid and, at the same time, forms an excellent dispersing agent which imparts good stability to the liquid developer.

The polarity control agents according to the invention have an advantageously low electrical conductivity. Therefore, they can be added to the developer liquids in a high concentration without causing undesirable conductivity values. On the other hand, they do not attack photoconductor layers consisting of or containing selenium.

In addition to the methacrylic acid ester component and the N-vinyl-2-pyrrolidone component, minor amounts of other monomers also may be added for the preparation of the polarity control agents according to the invention. Suitable monomers are those constituting acrylic monomers with a polar side chain, such as methacrylic acid, acrylic acid amide, or hydroxyalkyl methacrylate. These monomers are copolymerized in quantities of up to 5 percent by weight.

On the other hand, it was found that methacrylic acid esters with an alcohol component which contains not more than 6 carbon atoms also may be used as a further monomer component, the copolymer containing up to 30 percent by weight of the short-chain methacrylic acid ester.

The copolymers may be obtained by heating and simultaneously agitating a solution of N-vinyl-2-pyrrolidone and the methacrylic acid ester component in a nitrogen atmosphere in the presence of a polymerization initiator. Azoisobutyric acid dinitrile (AIBN) may be used as the initiator, for example. The polymerization temperature depends on the type of initiator used. If AIBN is used, the temperature preferably is in the range of about 70° to 90° C.

Polymerization is effected in a solvent, for which preferably the same aliphatic hydrocarbon is selected which later forms the main ingredient of the carrier liquid. If one of the polymerization components should be insoluble in this solvent, it is, of course, also possible to have the polymerization proceed in another solvent, for example toluene. In this case, the solvent used is removed after polymerization and the remaining polymer is dissolved in the aliphatic hydrocarbon.

Polymers which produce turbid solutions possess the best controlling effect. It is assumed that the turbidity is caused either by a high molecular weight or by a beginning graft polymerization of unspent N-vinyl-2-pyrrolidone on the copolymer chain formed.

The polarity control agent according to the invention may be used for the preparation of all types of liquid developers. Thus, it is possible, for example, to disperse normal carbon black in the polymer solution and then add fixing agents, such as soluble resins or polymer organosols, and possibly further quantities of the polarity control agent, to the dispersion. Instead of the normal carbon black mentioned above, resinated, flushed, or polymer-grafted carbon blacks or other pigments also may be used. In all cases, the polarity control agents according to the invention impart a definite, negative charge to the pigment particles.

Suitable additives, which may be incorporated in the liquid developer, are, for example, waxes which favorably influence the sedimentation behavior of the liquid developer or improve the fastness to wiping of the developed images. Normally, such additives are incorporated in a quantity which corresponds to the quantity of the pigment component.

It was found that, according to the present invention, favorable results are produced by incorporating smaller quantities. Thus, the useful life of a liquid developer may be considerably prolonged by adding only about 0.1 to 5 percent by weight, based on the weight of the pigment, of halogen-containing waxes.

Highly chlorinated or fluorinated paraffins are particularly suitable for use as halogen-containing waxes. The last-mentioned compounds, which are soluble in aliphatic hydrocarbons, are obtained by thermal decomposition of polytetrafluoethylene.

The invention will be further illustrated by reference to the following specific examples:

EXAMPLES

The following Examples 1 to 8 describe the preparation of the polarity control agent according to the invention. Examples 9 to 12 relate to liquid developers prepared with these polarity control agents.

EXAMPLE 1

100 g of an aliphatic hydrocarbon with a boiling range of 160° to 180° C., 70 g of 2-ethylhexyl methacrylate, 10 g of N-vinyl-2-pyrrolidone, and 0.3 g of AIBN are filled into a four-necked flask of 500 ml capacity provided with a stirrer, reflux condenser, thermometer and gas inlet pipe. While agitating, the mixture is rinsed with nitrogen for 10 minutes at room temperature and then heated in a nitrogen atmosphere on a glycerol bath. Polymerization proceeds for 6 hours at a bath temperature of 80° C. The resulting copolymer solution is almost clear.

EXAMPLE 2

600 g of an aliphatic hydrocarbon with a boiling range of about 160° to 180° C., 390 g of 2-ethylhexyl methacrylate, 90 g of N-vinyl-2-pyrrolidone, and 1.8 g of AIBN are filled into a four-necked flask equipped as in Example 1, but having a capacity of 2 liters. After rinsing the mixture for 10 minutes with nitrogen, it is polymerized for 5 hours at 80° C. The resulting viscous polymer solution is turbid.

EXAMPLE 3

Example 1 is repeated, using the following mixture: 100 g of the aliphatic hydrocarbon, 62.5 g of 2-ethylhexyl methacrylate, 17.5 g of N-vinyl-2-pyrrolidone, and 0.3 g of AIBN. Polymerization proceeds for 5 hours. A turbid polymer solution results.

EXAMPLE 4

100 g of an aliphatic hydrocarbon with a boiling range of about 160° to 180° C., 65 g of 2-ethylhexyl methacrylate, 15 g of N-vinyl-2-pyrrolidone, and 0.3 g of AIBN are agitated under a nitrogen atmosphere in the four-necked flask used in Example 1 while the temperature rises. The heating bath is maintained for 1 hour each at a temperature of 65° C., 70° C., 75° C., 80° C., 85° C., and 90° C. The polymer solution thus obtained has almost the same properties as that obtained according to Example 2.

EXAMPLE 5

The following mixture is polymerized for 5 hours at a temperature of 80° C., under a nitrogen atmosphere, in the four-necked flask used in Example 1: 100 g of an aliphatic hydrocarbon, 65 g of dodecyl methacrylate, 15 g of N-vinyl-2-pyrrolidone, and 0.3 g of AIBN. A slightly turbid polymer solution is thus obtained.

EXAMPLE 6

100 g of an aliphatic hydrocarbon with a boiling range of 160° to 180° C., 65 g of 2-ethylhexyl methacrylate, 13 g of N-vinyl-2-pyrrolidone, 2 g of 2-hydroxypropyl methacrylate, and 0.3 g of AIBN are polymerized for 4.5 hours at 80° C. in the four-necked flask used in Example 1. Because the resulting polymer solution tends to gelatinize, the still warm solution is filled up to a total volume of 400 ml with the aliphatic hydrocarbon first used. The polymer solution is slightly turbid.

EXAMPLE 7

100 g of an aliphatic hydrocarbon, 65 g of 2-ethylhexyl methacrylate, 14.5 g of N-vinyl-2-pyrrolidone, 0.5 g of methacrylic acid, and 0.3 g of AIBN are polymerized for 4.5 hours at a temperature of 80° C. A clear polymer solution is thus obtained.

EXAMPLE 8

300 g of an aliphatic hydrocarbon, 68.2 g of stearyl methacrylate, 40 g of N-vinyl-2-pyrrolidone, and 0.3 g of AIBN are polymerized for 5 hours at 80° C. The polymer solution thus obtained shows a milky turbidity.

EXAMPLE 9

36 g of carbon black are ground for three hours with 162 g of the polymer solution prepared as described in Example 2 and 300 g of an aliphatic hydrocarbon with a boiling range of 175° to 190° C., using a ball mill equipped with an agitator (type Molinex PE 5, manufactured by Messrs. Netzsch, Selb, Germany). Towards the end of the milling process, another 450 g of the hydrocarbon are added.

300 g of the carbon black dispersion thus obtained are mixed with 100 g of an organic polymer dispersion prepared according to Example 2 of German Offenlegungsschrift No. 2,114,773, and with 120 g of the polymer solution obtained according to Example 2 of the present application. By diluting the mixture with 13 liters of an aliphatic hydrocarbon with a boiling range of 160° to 180° C., a liquid developer is produced which cleanly develops positive charge images.

EXAMPLE 10

(a) Preparation of a Grafted Carbon Black

In a ball mill equipped with an agitator and with a sealed milling compartment provided with reflux condenser, a dropping funnel, and a gas inlet pipe (Molinex PE 5), 36 g of carbon black are dispersed within half an hour in 43.8 g of the polymer solution according to Example 2 and 300 g of an aliphatic hydrocarbon with a boiling range of 175° to 190° C. The resulting suspension is mixed with 109.5 g of dodecyl methacrylate, 9.6 g of vinyl acetate, 6.3 g of styrene, 1.2 g of methacrylic acid, and 0.23 g of AIBN. After replacing the air by nitrogen, graft polymerization is initiated by heating the milling compartment to 80° C. After heating it for 3.5 hours at 80° C., the compartment is slowly cooled to about 30° C. so that polymerization stops. The resulting grafted carbon black suspension is finally diluted by adding an additional 450 g of the aliphatic hydrocarbon with the boiling range of 175° to 190° C.

(b) Preparation of the Liquid Developer 60 g of the grafted carbon black suspension prepared as described above are mixed with 20 g of the organic polymer dispersion employed in Example 9 and with 10 g of the polymer solution obtained according to Example 2. By diluting the mixture with 2.5 liters of an aliphatic hydrocarbon with a boiling range of 160° to 180° C., a good negative developer liquid is obtained.

EXAMPLE 11

72 g of carbon black, 600 g of an aliphatic hydrocarbon with a boiling range of 175° to 190° C., and 100 g of a commercially available 40 percent solution of a terpolymer composed of 76 percent by weight of dodecyl methacrylate, 20 percent by weight of methyl methacrylate, and 4 percent by weight of N-vinyl-2-pyrrolidone in a neutral oil are stirred into a paste. After several hours' storage, the mixture is ground at 80° C. in a ball mill equipped with an agitator (Molinex PE 5). Towards the end of the dispersing process—which lasts three hours—the mixture is cooled to room temperature and an additional 900 g of the hydrocarbon is added.

1350 g of the resulting carbon black dispersion are mixed with 60 g of the above mentioned commercial terpolymer solution, 1350 g of an aliphatic hydrocarbon with a boiling range of 160° to 180° C., and 12 g of a saturated solution consisting of a chlorinated paraffin with a 70 percent chlorine component, which is dissolved in the same hydrocarbon as used above.

If the toner concentrate thus produced is diluted with an aliphatic hydrocarbon at a ratio of 1:12, a negative developer is obtained which produces good copies.

EXAMPLE 12

72 g of carbon black, 243 g of the polymer solution used in Example 5, and 600 g of an aliphatic hydrocarbon with a boiling range of 175° to 190° C. are mixed with 0.6 g of wax with a melting range of 78° to 86° C. which is produced by thermal decomposition of polytetrafluoethylene, and the mixture is ground for $3\frac{1}{2}$ hours in a ball mill with agitator of type Molinex PE 5. Towards the end of the grinding process, the mass is slowly diluted by adding a further quantity of 900 g of the hydrocarbon.

1200 g of the carbon black dispersion thus produced are mixed, while stirring, with an additional quantity of 60 g of the polymer solution used in Example 5 and 1200 g of an aliphatic hydrocarbon with a boiling range of 160° to 180° C.

By diluting the resulting toner concentrate with about 12 times its own quantity of the last-mentioned aliphatic hydrocarbon, a developer is obtained which yields more than 10,000 copies of good quality. If no polytetrafluoethylene wax is added, the copies produced with the developer after the first 1,000 prints are no longer quite free from tone.

It will be obvious to those skilled in the art that many modifications may be made within the scope of the present invention without departing from the spirit thereof, and the invention includes all such modifications.

What is claimed is:

1. In a liquid developer for the development of electrostatic charge images, comprising an electrically insulating carrier liquid in which pigments or dyestuffs, resinous binders, a polarity control agent, and conventional additives are dispersed or dissolved, the improvement that the polarity control agent is a negative charging copolymer which is soluble in the carrier liquid and is composed of 1 to 50 percent by weight of N-vinyl-2-pyrrolidone and 50 to 99 percent by weight of a methacrylic acid ester with an alcohol component which contains at least 6 carbon atoms in a straight or branched chain.

2. A liquid developer according to claim 1 in which the charge control agent is a copolymer which is composed of at least 15 to 40 percent by weight of N-vinyl-2-pyrrolidone and 60 to 85 percent by weight of a methacrylic acid ester.

3. A liquid developer according to claim 1 in which the copolymer contains 2-ethylhexyl methacrylate.

4. A liquid developer according to claim 1 in which the copolymer contains dodecyl methacrylate.

5. A liquid developer according to claim 1 in which the copolymer contains octadecyl methacrylate.

6. A liquid developer according to claim 1 in which the charge control agent is a copolymer which additionally contains an acrylo monomer.

7. A liquid developer according to claim 6 in which the charge control agent is a copolymer which additionally contains an acrylo monomer with a polar side chain.

8. A liquid developer according to claim 7 in which the copolymer contains up to about 5 percent by weight of an acrylo monomer with a polar side chain.

9. A liquid developer according to claim 7 in which the acrylo monomer with the polar side chain is selected from the group consisting of methacrylic acid, acrylic acid amide, and hydroxyalkyl methacrylate.

10. A liquid developer according to claim 6 in which the charge control agent is a copolymer which additionally contains a methacrylic acid ester with an alcohol component which contains not more than six carbon atoms.

11. A liquid developer according to claim 10, in which the copolymer contains up to about 30 percent by weight of a short-chain methacrylic acid ester.

12. A liquid developer according to claim 1 which comprises 0.1 to 5.0 percent by weight—based on the weight of the pigment or dyestuff—of a halogen-containing wax.

13. A liquid developer according to claim 12 in which the halogen-containing wax is a highly chlorinated paraffin.

14. A liquid developer according to claim 12 in which the halogen-containing wax is fluorinated paraffin.

* * * * *

UNITED STATES PATENT AND TRADEMARK OFFICE

CERTIFICATE OF CORRECTION

PATENT NO. : 4,243,736

DATED : January 6, 1981

INVENTOR(S) : Heinz Herrmann

It is certified that error appears in the above—identified patent and that said Letters Patent is hereby corrected as shown below:

Item [30] has been omitted from the above-identified patent and should read as follows:

[30] Foreign Application Priority Data

September 10, 1977 Fed. Rep. of Germany . . . . 2740870

Column 6, line 22, "with 0.6 g of wax" should read - - - with 0.6 g of a wax - - -.

Signed and Sealed this

*Fourteenth* Day of *April 1981*

[SEAL]

*Attest:*

RENE D. TEGTMEYER

*Attesting Officer*

*Acting Commissioner of Patents and Trademarks*